US008668532B2

(12) United States Patent
Lee et al.

(10) Patent No.: US 8,668,532 B2
(45) Date of Patent: Mar. 11, 2014

(54) CONNECTOR FOR LOW PROFILE FUSE

(75) Inventors: Chul-Sub Lee, Daegu (KR); Sang-Hee Lee, Kyungsangbuk-Do (KR)

(73) Assignee: Tyco Electronics Amp Korea Ltd., Kyungsangbuk-Do (KR)

( * ) Notice: Subject to any disclaimer, the term of this patent is extended or adjusted under 35 U.S.C. 154(b) by 0 days.

(21) Appl. No.: 13/299,840

(22) Filed: Nov. 18, 2011

(65) Prior Publication Data

US 2012/0077393 A1 Mar. 29, 2012

Related U.S. Application Data

(63) Continuation of application No. PCT/KR2010/002941, filed on May 10, 2010.

(30) Foreign Application Priority Data

May 19, 2009 (KR) ..... 10-2009-0043612

(51) Int. Cl.
*H01R 13/11* (2006.01)

(52) U.S. Cl.
USPC ..... 439/851; 439/890

(58) Field of Classification Search
USPC ..... 439/748, 843, 851, 852, 856, 857, 890
See application file for complete search history.

(56) References Cited

U.S. PATENT DOCUMENTS

| | | | | | |
|---|---|---|---|---|---|
| 4,877,409 | A * | 10/1989 | Tanigawa et al. | ..... | 439/31 |
| 4,992,062 | A * | 2/1991 | Nakayama et al. | ..... | 439/620.26 |
| 5,007,865 | A * | 4/1991 | Jakobeit | ..... | 439/839 |
| 5,151,056 | A * | 9/1992 | McClune | ..... | 439/851 |
| 5,681,190 | A * | 10/1997 | Childs | ..... | 439/856 |
| 5,954,548 | A * | 9/1999 | Stabroth | ..... | 439/839 |
| 6,066,007 | A * | 5/2000 | Huang | ..... | 439/748 |
| 6,095,874 | A | 8/2000 | Quaranta | | |
| 6,394,858 | B1 * | 5/2002 | Geltsch et al. | ..... | 439/852 |
| 6,464,547 | B2 * | 10/2002 | Ketelsleger | ..... | 439/851 |
| 6,790,101 | B1 * | 9/2004 | Data et al. | ..... | 439/851 |

(Continued)

FOREIGN PATENT DOCUMENTS

| | | | |
|---|---|---|---|
| JP | 10149855 | A | 6/1998 |
| KR | 100874963 | B1 | 12/2008 |
| WO | 2010/134712 | A2 | 11/2010 |

OTHER PUBLICATIONS

PCT International Search Report, PCT International application No. PCT/KR2010/002941, International filing date May 10, 2010, 3 pages.

(Continued)

*Primary Examiner* — Thanh Tam Le
(74) *Attorney, Agent, or Firm* — Barley Snyder

(57) ABSTRACT

A connector for a Low Profile (LP) fuse which has an increased fixing force, so as to prevent a secured LP fuse from being separated by external forces, such as vibration of a vehicle, etc. The connector for a Low Profile (LP) fuse includes a body, a rear member, and a pair of supporting arms. The body is adapted for insertion into a body receiving passageway of a fuse box. The body includes a lower end electrically connected to an electric wire. The rear member extends from the body into the body receiving passageway, while the pair of supporting members are bent from opposite sides of the rear member. The pair of supporting members extend parallel to each other.

9 Claims, 5 Drawing Sheets

(56) References Cited

U.S. PATENT DOCUMENTS

| | | | | |
|---|---|---|---|---|
| 6,811,450 | B1 * | 11/2004 | Data et al. | 439/748 |
| 6,945,830 | B2 * | 9/2005 | Copper et al. | 439/852 |
| 7,048,597 | B2 * | 5/2006 | Chen | 439/851 |
| 7,140,927 | B2 * | 11/2006 | Casses et al. | 439/852 |
| 7,717,759 | B2 * | 5/2010 | Ishigami | 439/851 |

OTHER PUBLICATIONS

European Search Report issued in co-pending EP Application No. 10777899.5, dated May 6, 2013, 7 pages.

Chinese First Office Action, issued in co-pending CN Application No. 201080022588.0, dated Aug. 22, 2013, 14 pages.

* cited by examiner

CONNECTOR FOR LOW PROFILE FUSE

CROSS-REFERENCE TO RELATED APPLICATION

The application is a continuation of PCT International Application No. PCT/KR2010/002941 filed May 10, 2010, which claims priority under 35 U.S.C. §119 to Korean Patent Application No. 10-2009-000043612 filed May 19, 2009.

FIELD OF THE INVENTION

The present invention relates to a connector and, more particularly, to a connector for an Low Profile (LP) fuse, which can assure easy insertion of the LP fuse and prevent the installed LP fuse from being separated by external shock, such as vibration of a vehicle, etc.

BACKGROUND

A Low Profile (LP) fuse is a kind of small fuse designed to reduce manufacturing costs and, more particularly, the LP fuse has a smaller height than other kinds of fuses. Referring to FIG. 6, a known LP fuse 200 is shown, having a body 220, a protrusion 230 protruding from the center of a lower surface of the body 220 so as to be inserted into a fuse box, and terminals 210 disposed at opposite ends of the protrusion 230, with the terminals 210 being made of a conductive metal.

The fuse box is provided with connectors. The connectors are electrically connected to the terminals, respectively, and provide the LP fuse with a fixing force to prevent separation of the LP fuse when inserted into the fuse box.

The connectors used in the fuse box should be designed to be assure easy insertion of the LP fuse because a plurality of LP fuses may be inserted into the fuse box and may be exchanged several times during a vehicle's lifespan. In addition, the connectors should provide the LP fuse with a fixing force sufficient to prevent separation of the LP fuse inserted into the fuse box even if external shock, such as vibration of a vehicle, etc., is applied. The connectors also should have a sufficient cross sectional area in consideration of the quantity of current passing through the LP fuse.

FIG. 7 shows a known connector that may be positioned in a fuse box according to the related art.

The known connector includes a body 310 configured to be fixed to the bottom of a recess defined in a fuse box and having a fixture formed at a lower end thereof for the connection of an electric wire, and a pair of elastic pieces 320 extending from an upper end of the body 310 to protrude from the recess of the fuse box, in order to receive and secure the terminals of an LP fuse.

The elastic pieces 320 are obliquely bent such that a distance between both the elastic pieces 320 is upwardly reduced. Upper ends of the elastic pieces 320 bend outward and extend away from each other, such that a corresponding LP fuse terminal can be easily inserted downward toward the a top of the elastic pieces 320.

Accordingly, the pair of elastic pieces 320 elastically bend outward in order to receive a LP fuse terminal and to press and secure the LP fuse terminal through a restoring force thereof.

The elastic pieces 320 of the connector according to the related art, however, extend upward from the body 310 and do not exhibit a strong fixing force, thus causing an LP fuse to be easily separated from the fuse box due to vibration generated during driving of a vehicle. Specifically, despite the fact that the securing of the LP fuse depends on only a press force of the elastic pieces 320 used to secure a terminal of the LP fuse, the elastic pieces 320 take the form of cantilevers extending upward from the body 310 and, thus are greatly affected by vibration, showing deterioration in a fixing force.

To solve the above described disadvantage of the connector according to the related art, attempts have been made to maximize a restoration force of the elastic pieces 320 when the elastic pieces 320 are pushed away from each other upon insertion of the terminal. To this end, the elastic pieces 320 have been configured to be closer to each other in an upward direction, such that the upper ends of the elastic pieces 320 come into contact with each other.

However, the above described configuration does not provide a basic solution to the continuous vibration generated in the course of a vehicle's lifespan and, also, includes difficulty in assembly of an LP fuse because the elastic pieces 320, the upper ends of which come into contact with each other, cause an increased insertion force required to press and insert the LP fuse in order to push the elastic pieces 320 away from each other.

In particular, in the case where a plurality of LP fuses are simultaneously assembled into a fuse box during an assembly of a vehicle, a significant insertion force is required on a per LP fuse basis, causing difficulty in assembly of all the LP fuses.

SUMMARY

Therefore, the invention has been made in view of the above problems and, it is an object of the invention, inter alia, to provide a connector for a Low Profile (LP) fuse with an increased fixing force, so as to inhibit a secured LP fuse from being separated by external forces, such as vibration of a vehicle, etc.

The connector for a Low Profile (LP) fuse includes a body, a rear member, and a pair of supporting arms. The body is adapted to be inserted into a body receiving passageway of a fuse box. The body includes a lower end electrically connected to an electric wire. The rear member extends from the body into the body receiving passageway, while the pair of supporting members are bent from opposite sides of the rear member. The pair of supporting members extend parallel to each other.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EMBODIMENT(S)

Hereinafter, functions, configurations, and operation of connectors for a Low Profile (LP) fuse according to embodiments of the invention will be described in detail with reference to the accompanying drawings.

Figure 1:
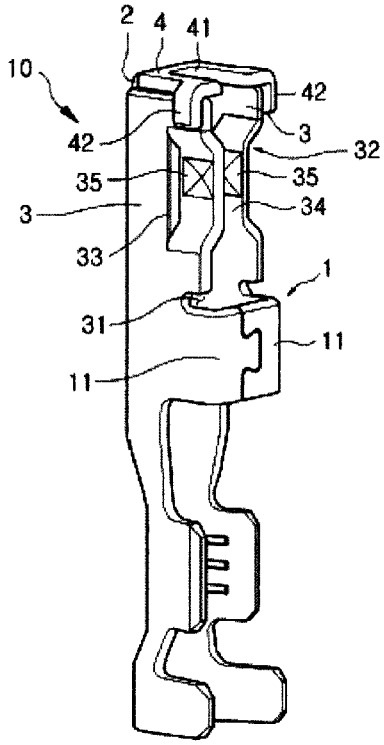
FIG. 1 is a perspective view of a connector according to the invention.
Figure 2:
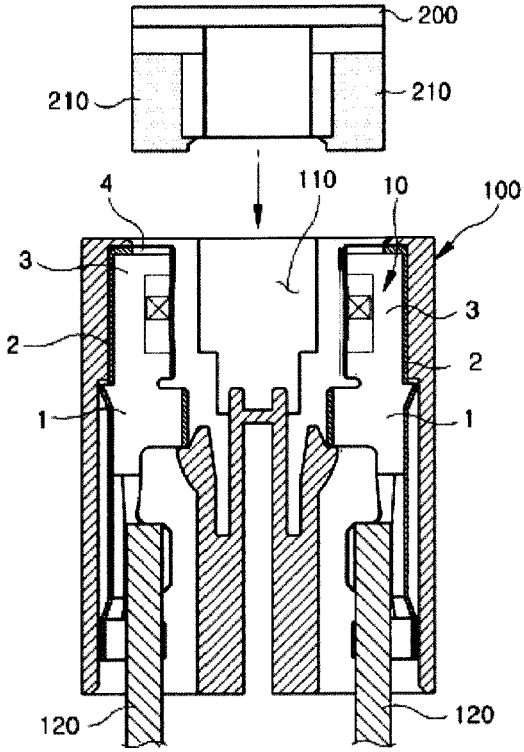
FIG. 2 is a sectional view of the connector shown in FIG. 1.

With reference to FIGS. 1 and 2, a connector 10 for a Low Profile (LP) fuse includes a body 1, a rear member 2, and a pair of supporting members 3. The body 1 is inserted into a body receiving passageway defined in a fuse box and is secured to a bottom surface of the body receiving passageway, while a lower end of the body 1 is electrically connected to an electric wire 120. The rear member 2 extends from the body 1 into the body receiving passageway. Each of the supporting members 3 is bent from respective opposite sides of the rear member 2 and extends parallel to the other in a direction orthogonal to an inserted terminal of the LP fuse, thus serving to fix the terminal.

The body 1, as illustrated in FIG. 2, is fixed to the bottom surface of the body receiving passageway 110 defined in the fuse box 100. The body 1 may be inserted and fixed by use of a lance, or may be formed by insert injection molding. The lower end of the body 1 may have a known configuration to be electrically connected to the electric wire 120.

The rear member 2 extends upward from the body 1, and takes the form of a flat plate extending from either inner side surface of the body receiving passageway 110.

The supporting members 3, which are bent from opposite sides of the rear member 2 and extend parallel to each other, come into contact with the terminal 210 of the LP fuse 200 so as to secure the terminal 210.

In this case, to assure the flow of a sufficient quantity of current required for normal operation of the LP fuse 200, it is important that the rear member 2 has a horizontal width larger than a thickness of the terminal 210, so as to achieve a sufficient cross sectional area for the flow of current. Thus, in order for the supporting members 3 to secure to allow the terminal 210 to be caught by, the supporting members 3 which are bent from opposite sides of the rear member 2 having the large horizontal width, may be additionally provided with holding pieces that will be described hereinafter. Alternatively, the supporting members may be bent by a great inclination to become close to each other.

The terminal 210, inserted between both the supporting members 3, pushes the supporting members 3 away from each other, and the supporting members 3 pushed away from each other press and secure the terminal 210 through a restoration force thereof Lower ends of the supporting members 3 are integrally formed with the body 1, to assure a further increased restoration force of the supporting members 3. Specifically, the body 3 may include L-shaped lateral pieces 11 extending horizontally from opposite sides immediately beneath the rear member 2 to constitute a block together. The lower ends of the supporting members 3 may be connected to the lateral pieces 11.

More specifically, the body 1 may define a block as the lateral pieces 11 extend in an L-shaped form from opposite sides immediately beneath the rear member 2, while facing distal ends of the lateral pieces 11 are coupled to each other. In this case, the lateral pieces 11, coming into contact with each other, may be welded to each other. Alternatively, one of the lateral pieces 11 may be formed with a recess and the other lateral piece 11 may be formed with a protrusion that corresponds to the recess, such that both the lateral pieces 11 are secured to each other when the recess engages with the protrusion.

When the lower ends of the supporting members 3 are integrally formed with the block of the body 1, the supporting members 3 acquire an increased elastic force that when applied pushes both the supporting members 3 away from each other.

In addition, a recess 31 may be indented in a connection region between the lower end of the supporting member 3 and the lateral piece 11. With this configuration, a length from the rear member 2 to the recess 31, i.e. a horizontal length of the supporting member 3 is partially reduced, which causes a reduction in a force required to push the supporting members 3 outward away from each other.

Accordingly, when the LP fuse 200 is inserted into the body receiving passageway 110, an initial insertion force required to push the supporting members 3 away from each other can be reduced.

In the meantime, as described above, to fix the terminal 210 of the LP fuse 200 using the supporting members 3, the supporting members 3 may be provided respectively with holding pieces 32.

The holding pieces 32 are centrally indented such that center portions of the supporting members 3 are closer to each other than the remaining portions of the supporting members 3. In this case, one side end of each holding piece 32 is not connected to the corresponding supporting member 3 through provision of a vertical incision 33, whereas upper and lower ends of the holding piece 32 are connected to the supporting member 3.

Figure 4:
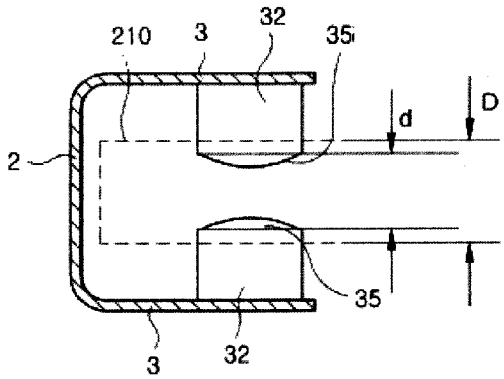
FIG. 4 is a sectional view taken along the line a-a of FIG. 3.

The holding pieces 32 are inwardly indented from the respective supporting members 3 such that a distance d between the holding pieces 32 is smaller than a thickness D of the terminal 210 (in FIG. 4, $d<D$).

The above described holding pieces 32 increase a cross sectional area for the passage of current and also, to define a space into which the terminal 210 can be fitted.

The holding pieces 32 may have flat surfaces 34 facing each other, and press protrusions 35 may be disposed at the flat surfaces 34 to press the terminal 210 fitted between the holding pieces 32. Specifically, the flat surfaces 34 are formed respectively at the holding pieces 32 to be parallel to each other, and the press protrusions 35 are raised from the facing flat surfaces 34 by, for example, punching.

The press protrusions 35 come into point contact with the terminal 210. This can further increase a press force applied to the terminal 210 and achieve perfect electric connection between the terminal 210 and the connector 10.

Figure 5:
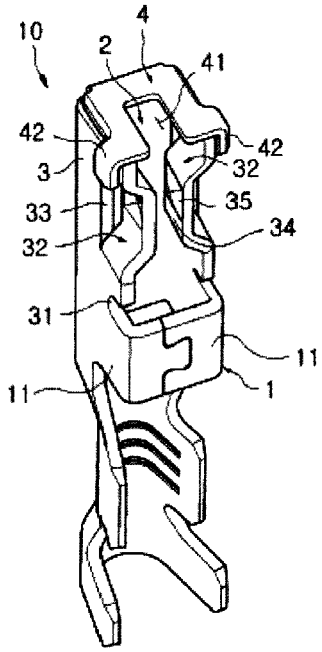
FIG. 5 is a perspective view showing another connector according to the invention.
Figure 6:
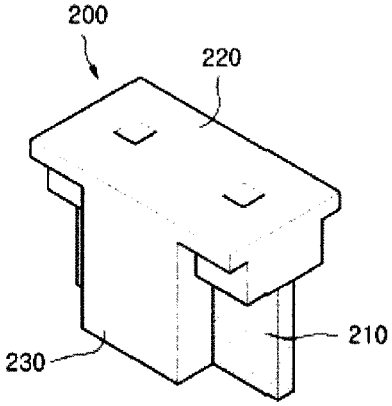
Fig. 6 PRIOR ART
FIG. 6 is a perspective view of a known LP fuse.
Figure 7:
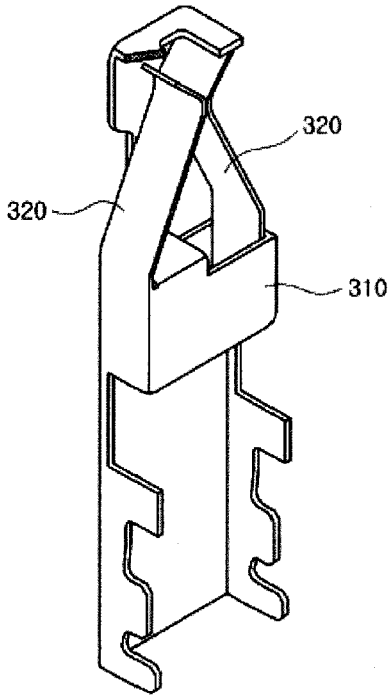
Fig. 7 PRIOR ART
FIG. 7 is a perspective view of a known connector.

No with reference to FIG. 5, a modified configuration of the connector 10 is shown, where an upper end of the connector 10 is exposed to the outside from the top of the body receiving passageway 110 and therefore, the supporting members 3 may be easily deformed due to deformation interference caused by invasion of impurities from the outside or improper assembly of the LP fuse 200. Accordingly, to protect the supporting members 3, a cover 4 may further extend from the rear member 2 to cover the upper ends of the supporting members 3.

The cover 4 extends throughout the upper end of the rear member 2 and the upper ends of the supporting members 3 to have a U-shaped form, and thus, is formed with an terminal receiving passageway 41 for the passage of the terminal 210.

In this case, if the terminal 210 is unconventionally inserted between the supporting members 3 rather than being inserted on a median axis between the supporting members 3, a lower end of the terminal 210 is caught by the cover 4. This can prevent excessive deformation of the supporting members 3 caused when the LP fuse 200 is inserted in an incorrect direction and invasion of impurities.

In addition, the cover 4 may be formed at opposite sides thereof with reinforcing pieces 42. The reinforcing pieces 42 extend downward orthogonally from opposite sides of the cover 4 to surround the upper ends of the supporting members 3, thereby serving to prevent the supporting members 3 from being excessively pushed outward away from each other.

Specifically, the reinforcing pieces 42 are formed at opposite distal ends of the cover 4 to surround front corners of the supporting members 3 since the front corners exhibit the greatest outward displacement upon insertion of the LP fuse 200. In this case, the reinforcing pieces 42 are spaced apart from the supporting members 3, rather than coming into contact with the supporting members 3.

In this case, a distance between the supporting member 3 and the reinforcing piece 42 is determined in consideration of an outwardly moved distance of the supporting member 3 caused when the supporting member 3 is pushed outward by the terminal 210 upon insertion of the LP fuse 200. When the LP fuse 200 is obliquely inserted, the supporting member 3 is supported by the reinforcing piece 42, which can prevent the supporting member 3 from being excessively pushed outward.

Moreover, since the supporting member 3 and the reinforcing piece 42 do not normally come into contact with each other, the supporting member 3 does not act to push the reinforcing piece 42 outward under a normal LP fuse assembly situation, and thus, there is no need for an additional insertion force to elastically deform the reinforcing piece 42 upon insertion of the LP fuse 200.

Accordingly, the reinforcing piece 42 can prevent the supporting member 3 from being excessively pushed outward without an increase in the insertion force of the LP fuse 200.

Hereinafter, operation of the connector 10 according to the invention will be described with reference to FIGS. 1 to 4.

The connector 10 for the LP fuse 200, as described above, is configured such that the symmetrical supporting members 3 come into contact with the terminal 210 and thus, function to secure the terminal 210

The supporting members 3, as shown in FIG. 2, extend from the rear member 2 in a direction orthogonal to a vertical insertion or separation direction (a Z-axis direction) of the LP fuse 200, thereby serving to elastically support the terminal 210.

Figure 3:
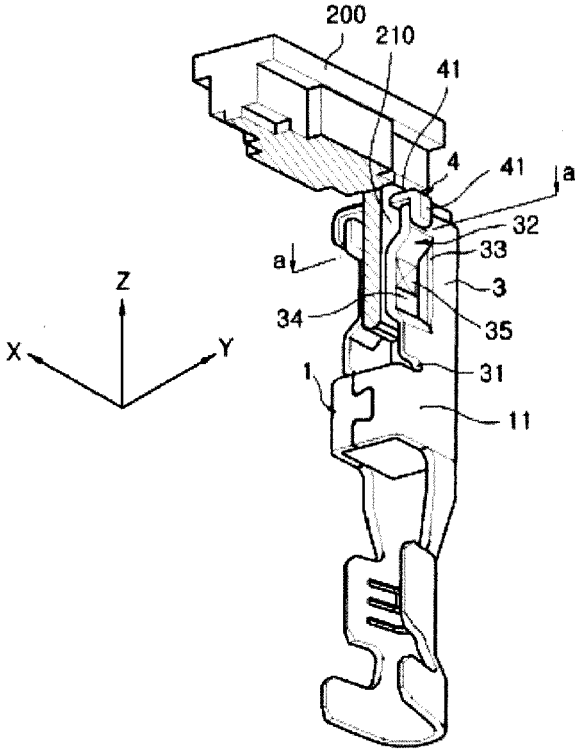
FIG. 3 is a partial cut-away perspective view showing the connector shown in FIG. 1 connecting to a low profile (LP) fuse.

More specifically, FIGS. 3 and 4 clearly illustrate the insertion and securing relationship between the terminal 210 and the connector 10, the terminal 210 has a large length in the insertion direction (a vertical direction or Z-axis direction) of the LP fuse 200, but has a relatively small length in a front and rear direction (an X-axis direction) orthogonal to the insertion direction. The small length portion of the terminal 210 is caught by the connector 10.

In this case, assuming that the rear member 2, which does not undergo elastic deformation upon insertion of the LP fuse 200, is a stationary wall, and that the supporting members 3, which extend from the rear member 2 and are elastically displaced by the terminal 210, are cantilevers fixed to the stationary wall, each supporting member 3 can take the form of a cantilever that has a lengthy vertical connection length with respect to the stationary wall, but has a relatively small protruding length.

It will be appreciated that the above described cantilever (the supporting member 3), having a lengthy connection length and a small protruding length, exhibits a greater elastic force against an external force than that of a conventional elastic piece in the form of an elongated cantilever.

In conclusion, according to the invention, the supporting member 3 extends by a small length from the rear member 2 in an X-axis direction orthogonal to the insertion direction (a Z-axis direction) of the LP fuse 200, thus exhibiting a great elastic force and consequently, providing the LP fuse 200 inserted in the body receiving passageway 110 with a considerably great fixing force.

Accordingly, the supporting member 3 can keep the LP fuse 200 secure despite vibration caused during driving of a vehicle and furthermore does not exhibit deterioration in an elastic force when faced with continuous, long time vibration.

The force of the supporting member 3 may be further increased by providing the holding piece 32 with the press protrusion 35. That is, a fixing force for the inserted LP fuse can increase a vertical drag force by a pair of indentations defined by the holding piece 32 and the press protrusion 35, resulting in a considerably increased frictional force when the LP fuse is pulled out.

In the meantime, a distal end of the press protrusion 35 exhibits a reliable local surface contact with a surface of the terminal 210. Thus, the press protrusion 35 functions to prevent short circuiting between the LP fuse 200 and the connector 10 and to achieve reliable electrical connection between the terminal 210 and the supporting members 3.

Both the holding pieces 32 and more particularly, both the press protrusions 35 are spaced apart from each other and thus, it is unnecessary to provide the LP fuse 200 with a great insertion force upon initial insertion thereof As shown in FIG. 4, since the flat surfaces 34 of the holding pieces 32 are originally spaced apart from each other, the supporting members 3 can exhibit a small deformation length when they are elastically displaced by the terminal 210.

In addition, the incision 31 punched between the supporting member 3 and the body 1 can allow the supporting member 3 to be pushed outward even by a small insertion force upon insertion of the LP fuse 200.

With the above described configuration, it is possible to reduce an insertion force required to insert and fix the LP fuse and to prevent the inserted LP fuse from being unintentionally separated by external shock, such as vibration of a vehicle, etc. As a result, enhanced efficiency of assembly and operation reliability of the LP fuse can be accomplished Various embodiments have been described in the best mode for carrying out the invention.

Although the preferred embodiments of the invention have been described for illustrative purposes, those skilled in the art will appreciate that various modifications, additions, and substitutions are possible, without departing from the scope and sprit of the invention as described in the accompanying claims.

What is claimed is:

1. A connector for a Low Profile (LP) fuse comprising:

a body adapted for insertion into a body receiving passageway of a fuse box and having a lower end electrically connected to an electric wire;

a rear member extending from the body and adapted for reception into the body receiving passageway;

a pair of supporting members, each individually bent from each opposite side of the rear member and extending parallel to each other and having a holding piece with upper and lower ends connected to each of the supporting members such that each holding piece of the pair of supporting members is inwardly indented toward each other;

a recess indented in a connection region between the lower ends of the pair of supporting members and the body; and a vertical incision disposed between the supporting member and the holding piece.

2. The connector according to claim 1, wherein the holding piece includes a flat surface that face each other.

3. The connector according to claim 2, further comprising a press protrusion disposed on an inward surface of the flat surface.

4. The connector according to claim 1, further comprising a cover extending over an upper end of the rear member and the upper ends of the supporting members.

5. The connector according to claim 4, wherein the cover includes a terminal receiving passageway for receiving a terminal of the LP fuse being inserted between the pair of supporting members.

6. The connector according to claim 5, wherein the cover includes a pair of reinforcing pieces bent from opposite sides of the cover.

7. The connector according to claim 6, wherein the pair of reinforcing pieces surround the upper ends of the supporting members.

8. The connector according to claim 7, wherein the pair of supporting members are (1) pushed outward away from each other when the terminal is inserted and (2) contact the pair of reinforcing pieces such that a distance between the pair of supporting member when the pair of supporting member move away from each is limited by the pair of reinforcing pieces.

9. A connector for a Low Profile (LP) fuse comprising:

a body adapted for insertion into a body receiving passageway of a fuse box and having a lower end electrically connected to an electric wire;

a rear member extending from the body and adapted for reception into the body receiving passageway;

a pair of supporting members, each individually bent from each opposite side of the rear member and extending parallel to each other and having a holding piece with upper and lower ends connected to each of the supporting members such that each holding piece of the pair of supporting members is inwardly indented toward each other;

a recess indented in a connection region between the lower ends of the pair of supporting members and the body;

a vertical incision disposed between the supporting member and the holding piece; and a cover extending from the rear member and having reinforcing pieces formed on opposite distal ends of the cover that surround corners of the pair of supporting members.

* * * * *